United States Patent [19]

Wacksman

[11] 4,431,391

[45] Feb. 14, 1984

[54] ROTARY PUMP

[76] Inventor: David J. Wacksman, Barkley Dr. West Apt. A, West Palm Beach, Fla. 33406

[21] Appl. No.: 390,690

[22] Filed: Jun. 21, 1982

[51] Int. Cl.[3] ..... F04C 2/00

[52] U.S. Cl. ..... 418/173

[58] Field of Search ..... 418/172, 173, 174, 176, 418/177, 138, 255

[56] References Cited

U.S. PATENT DOCUMENTS

| | | | |
|---|---|---|---|
| 219,365 | 9/1879 | Pernot | 418/255 |
| 1,806,206 | 5/1931 | Lees | 418/173 |
| 2,316,318 | 4/1943 | Davidson | 418/174 |

FOREIGN PATENT DOCUMENTS

| | | | |
|---|---|---|---|
| 13070 | of 1884 | United Kingdom | 418/173 |

*Primary Examiner*—John J. Vrablik
*Assistant Examiner*—John J. McGlew, Jr.
*Attorney, Agent, or Firm*—Malin & Haley

[57] ABSTRACT

A rotary pump including a circular case, and mating cover forming a cylindrical cavity, an outer ring sized for rotating within the case cavity, a partial inner ring sized for relative rotation within the outer ring, and a driven elongated blade pivotally interlocked at one end to the inner ring. The other end of the blade is held for pivotal and sliding movement to the outer ring by a mating knuckle which slidably receives the blade end while being pivotably locked into the ring. The axis of the drive shaft which rotates the blade is positioned off-center from that of the concentric sealing rings and case. Fluid entrance and exhaust ports may be provided in either or both the case and mating cover.

5 Claims, 9 Drawing Figures

ROTARY PUMP7

BACKGROUND OF THE INVENTION

This invention relates generally to fluid pumps and particularly to a rotary input positive displacement pump having an off-center drive shaft from that of the concentric sealing rings and pump case.

Prior art rotary driven fluid pumps such as those based upon a rotating polygonal rotor described in U.S. Patents- 3,894,819
3,288,119
3,551,080
3,299,822
3,671,153
3,387,772
3,716,314
4,150,926
4,278,409 included one or more of the following shortcomings. The seals between the stationary housing and the rotating member were short-lived and even self-destructive. Flexible vane pumps are incapable of producing high pressure while gear-type pumps are relatively low volume devices.

The present invention provides a high-volume positive displacement pump having a rotationally driven blade which creates a pressure differential and thusly, fluid flow within a circular pump case cavity split by the blade. As the blade is rotated about an axis non-aligned with the center of the circular case, the unique geometry created herein provides the high fluid flow characteristics of the instant pump. A unique sealing means between the ends of the rotating blade and the cavity ring portion of the circular case in the form of concentric rings within the case is also provided.

BRIEF DESCRIPTION OF THE INVENTION

An improved rotary fluid pump comprising a circular cylindrical casing and mating cover creating a cavity for housing a rotationally drive elongated pressure blade. The blade is driven by a rotating shaft positioned off-center from the axis of the casing in order to provide the geometry required for creating alternating positive and negative pressure areas within the sealed casing cavity. Fluid flow into and out of the casing cavity in through ports stratigically positioned in the casing side and/or cover.

To accomplish the sealing of the ends of the rotating blade to the stationary casing inner circular wall, a partial inner and an outer mating pair of concentric circular rings are matingly seated for rotation within the casing which are driven by the inter-connecting ends of the blade. One end of the blade is pivotably locked to the partial inner ring while the other end of the blade is pivotably and slidably held by an intermediate knuckle to the outer ring. The sliding movement occurs between the knuckle and the mating end of the blade to accommodate off-center rotational geometry of the rotating blade.

To aid in overall sealing of this pump, and inherent in this design, are large surface areas of contact between mating pivotal and sliding surfaces. The larger surfaces also provide reduced unit pressure between mating surfaces required to accomplish sealing and therefore reduced wear and friction.

It is therefore an object of this invention to provide an improved fluid pump.

It is another object of this invention to provide a fluid pump with improved inherent sealing means.

It is yet another object of this invention to provide a high volume positive displacement fluid pump with improved sealing characteristic.

In accordance with these and other objects which will be apparent hereinafter the instant invention will now be described with particular reference to the accompanying drawings.

PREFERRED EMBODIMENT OF THE INVENTION

Figure 1:
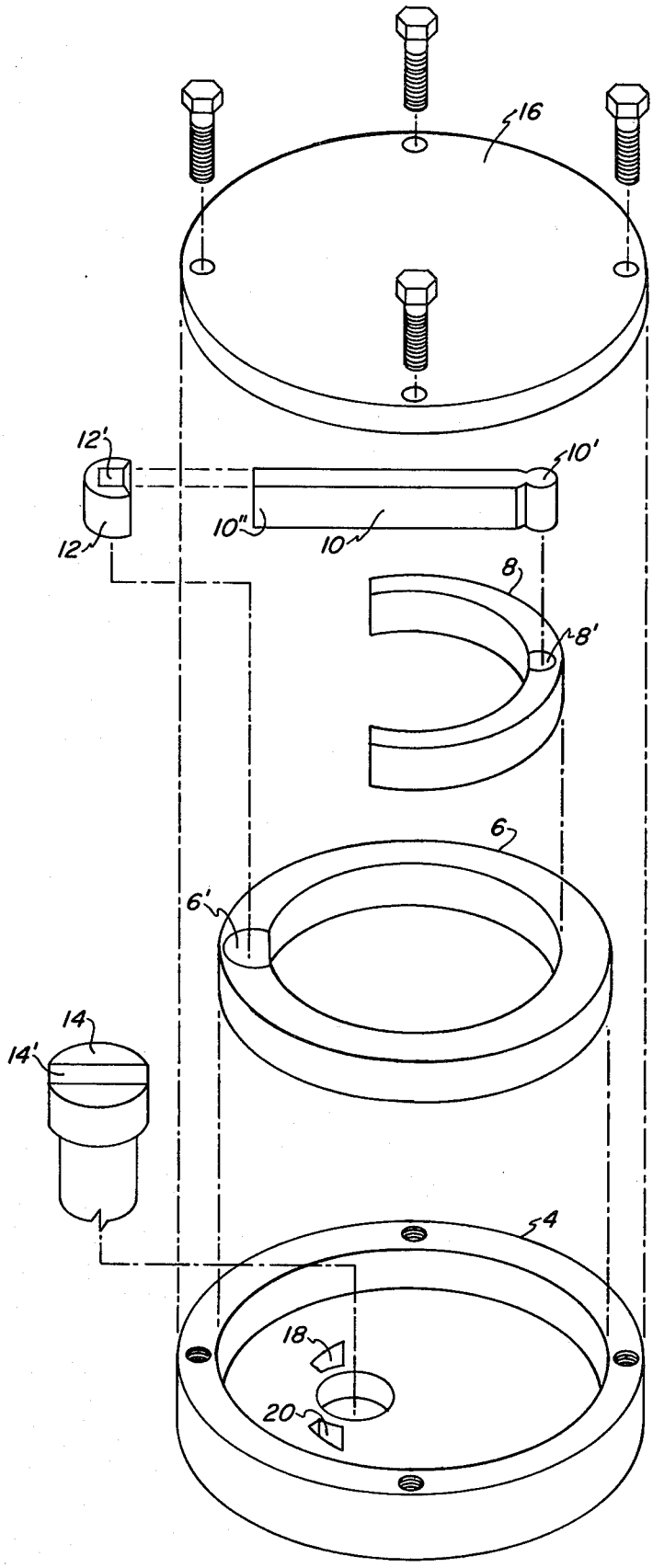
FIG. 1 shows a perspective exploded view of the invention.
Figure 2:
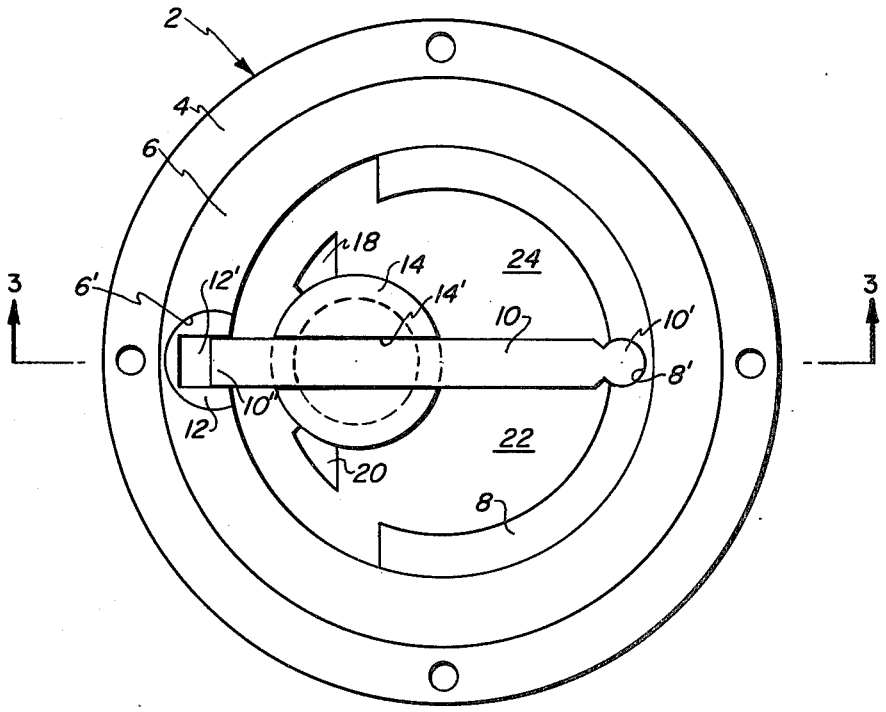
FIG. 2 is a plan view of the invention with the cover removed.

Referring now to the drawings and particularly to FIGS. 1 and 2, the invention is shown generally at 2 and includes a case 4, an outer ring 6, positioned and sized for rotation within the case 4, and a partial inner ring 8, positioned and sized for relative rotation within the outer ring. The case outer and inner rings are concentric. Pressure blade 10 is generally an elongated bar having a knuckle portion 10' at one end. This knuckle portion 10' lockably seats within a mating pocket 8' in partial inner ring 8 so that pocket 8' is positioned approximately at the mid-point of partial ring 8. Fluid seal from one side of the blade to the other is maintained by that pivotal connection.

The opposite end 10" of the blade is held within a separate knuckle 12 which is also lockably held in a mating pocket 6' in the other ring 6 for only pivotal motion within the plane of the pump. Knuckle 12 includes a pocket 12' for receiving the straight end 10" of the blade. These pockets 6' and 12' are sized to maintain a fluid seal from one side of the blade to the other.

Figure 3:
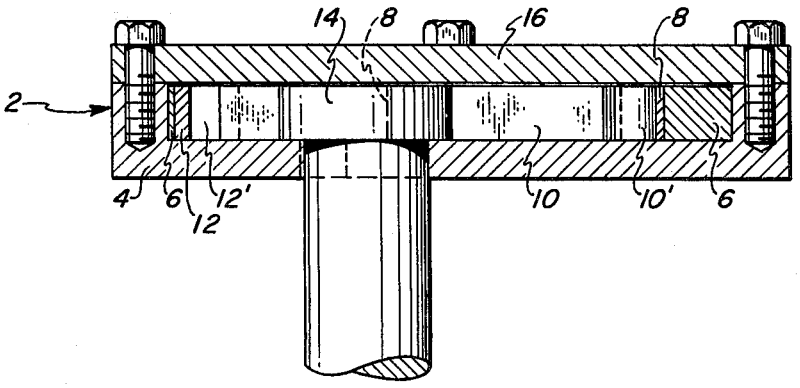
FIG. 3 is a side elevation view of the pump.

As shown in FIGS. 1 and 3, cover 16 matably seals against the case to form the cavity into which the rings, blade and knuckle are assembled and held for rotation. Drive shaft 14 is fitted into a sealable hole in either the case side or the cover, preferrably the cover. The rotational axis of the drive shaft 14 is perpendicular to the plane of the pump. The end of the drive shaft includes a slot which slidably seats over the blade, saddle-style. This saddle-type interengagement between blade and drive shaft serves as the means for transferring the rotational input of the drive shaft to the blade.

The pump also includes intake and exhaust ports 18 and 20 which are externally connected (not shown) to the source and the storage or discharge means for the fluid conveyed. These ports, which may be located in the case side or the cover, or both, are stratigically shaped and positioned relative to the location and size of the drive shaft and rings to provide the geometry required during each full 360° revolution of the blade to alternately and timely uncover and seal each port for proper fluid flow into and out of the pump as herebelow described.

FIGS. 4A through 4F show the geometric analysis of how this pump works. Starting from a neutral position of FIG. 4A wherein chamber portions 22 and 24 are approximately equal and keeping in mind that proper sliding sealing has been accomplished to separate pump chamber portions 22 and 24, the total physical volume of which remains approximately constant, as the blade and rings are rotated to the position shown in FIG. 4B, it is clear that chamber portion 22' is substantially smaller and that chamber portion 24' is substantially larger. These chamber portion size changes have the effect of forcing fluid out of exit port 20 while drawing fluid into chamber portion 24' through entrance port 18. The integrity of the pump is maintained at this position and beyond by the contact of the inner ring and the drive shaft at 26. It will be noted that the distance between pocket 8' in the inner ring and pocket 6' in the outer ring is shortened in FIG. 4B. This change is compensated for by allowing the straight end 10'' of the blade to slide within the knuckle pocket 12', which is sized to accomodate all such changes in distance during the entire rotational cycle of the pump.

Figure 4A:
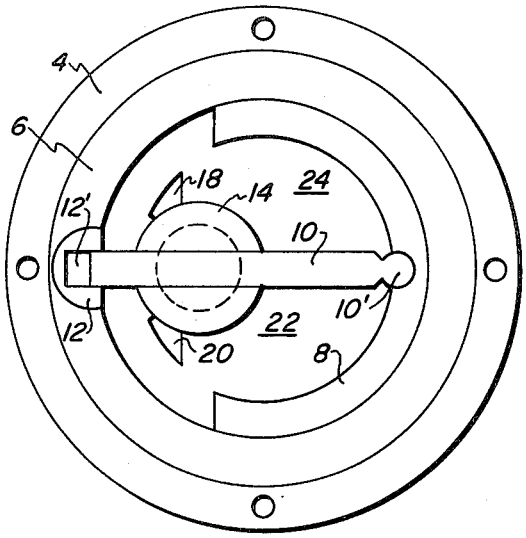
FIG. 4A through 4F show the progression of the blade and rings through one complete rational cycle.
Figure 4B:
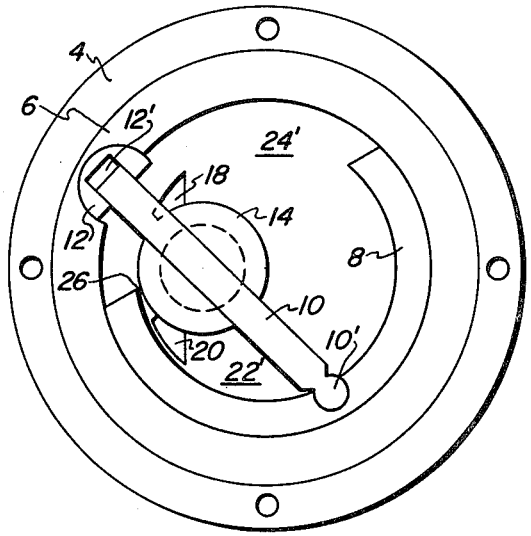
Figure 4C:
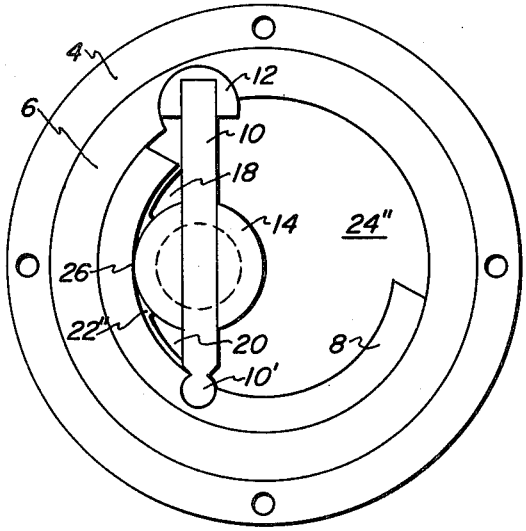

In FIG. 4C the blade has been rotated approximately 90°. At this position the blade has exhausted virtually all of the fluid in chamber portion 22'' out through port 20 and is now ready to begin to pressurize the fluid contained in chamber portion 24''. Note that the distance between pockets 10' and 6' is at the minimum in this blade position and that the straight blade end 10'' is at its maximum pentration into pocket 12'.

Figure 4D:
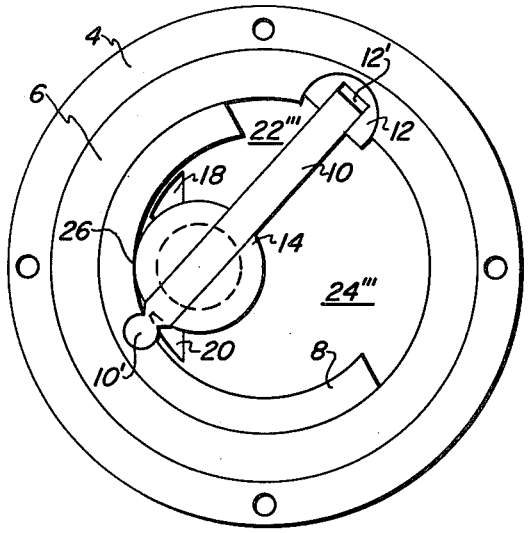

At the blade position shown in FIG. 4D, chamber portion 22'' is increasing in size, drawing fluid into that chamber portion while chamber portion 24'' is decreasing in size, compressing the fluid therein and exhausting same from that chamber portion.

Figure 4E:
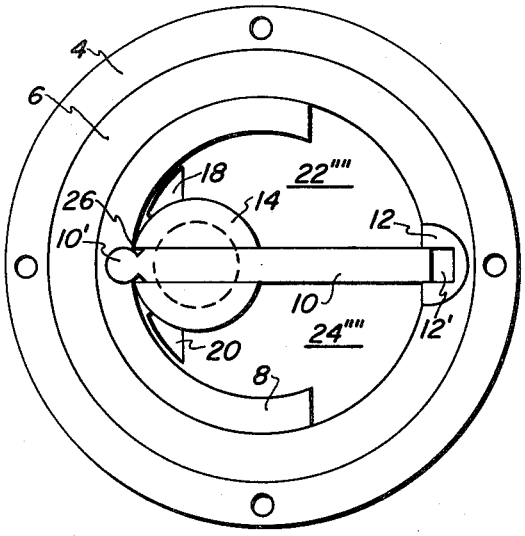
Figure 4F:
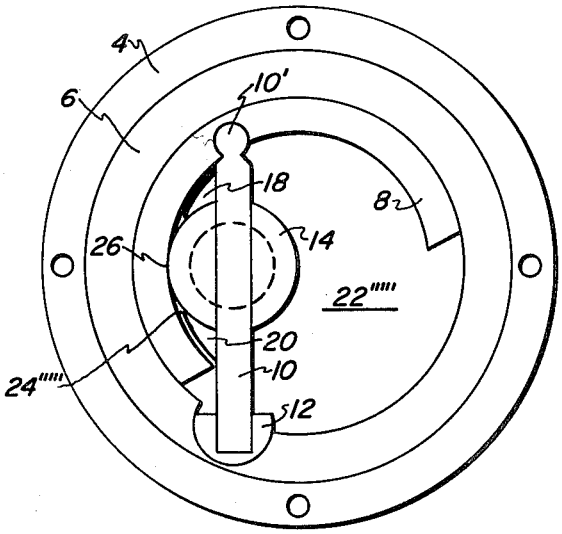

This process of drawing fluid into expanding chamber portion 22'' and exhausting fluid from chamber portion 24'' continues through the position shown in FIGS. 4E through 4F, where the blade has been rotated 270° from the start reference position of FIG. 4A.

The instant invention has been shown and described herein in what is considered to be the most practical and preferred embodiment. It is recognized, however, that departures may be made therefrom within the scope of the invention and that obvious modifications may occur to a person skilled in the art.

What I claim is:

1. A rotary fluid pump comprising:

a case, said case having a planar, generally circular side portion and a circular ring portion around the perimeter on one side of said circular side portion;

a cover, said cover matably mountable onto said circular ring portion of said case;

an outer circular ring matable to the inner surface of said circular ring portion;

said outer ring having a first pocket, said first pocket opening inwardly toward the center of said outer ring;

said outer ring sized for rotation within said case;

an inner circular ring having a segment removed;

said inner ring having a second pocket, said second pocket opening inwardly toward the center of said inner ring;

said inner ring sized for relative rotation within said outer ring;

said case, said outer ring and said inner ring having a common concentric axis;

an elongated blade having a first end and a second end;

said first end of said blade pivotally connected to said first pocket in said outer ring;

said second end of said blade pivotally connected to said second pocket in said inner ring;

said pivotal connection between said blade first end and said first pocket including means for allowing relative linear movement between said blade first end and said first pocket;

means for intaking fluid into said pump;

means for exhausting fluid from said pump;

drive means slidably connected to said blade;

said drive means for rotating said blade within the plane of said case;

the rotational axis of said drive means perpendicular to said plane of said case;

said drive means axis positioned from said concentric axis.

2. A rotary fluid pump as set forth in claim 1 wherein said fluid intake and exhaust means are positioned in said case side.

3. A rotary fluid pump as set forth in claim 1 wherein said fluid intake and exhaust means are positioned in said cover.

4. A rotary fluid pump as set forth in claim 1 wherein said fluid intake and exhaust means are positioned in said case side and said cover.

5. A rotary fluid pump as set forth in claim 1 wherein:

said means for allowing relative linear movement between said blade first end and said first pocket is a knuckle;

said knuckle having a circular outer cylindrical surface rotatable within said first pocket;

said knuckle having an inner pocket for slidably receiving said blade first end. R7

* * * * *